United States Patent [19]

Frohwerk et al.

[11] 4,332,327

[45] Jun. 1, 1982

[54] ACCURATELY PLACED STRESS CONCENTRATING APERTURE IN FLEXIBLE PACKAGES

[75] Inventors: Arthur E. Frohwerk, Harrison, Ohio; David E. Enting, Americas, Ga.

[73] Assignee: The Procter & Gamble Company, Cincinnati, Ohio

[21] Appl. No.: 147,018

[22] Filed: May 6, 1980

[51] Int. Cl.[3] ..... B65D 65/26

[52] U.S. Cl. ..... 206/604; 206/484

[58] Field of Search ..... 206/604, 601, 484

[56] References Cited

U.S. PATENT DOCUMENTS

| | | | |
|---|---|---|---|
| Re. 27,913 | 2/1974 | Hutcheson . | |
| 564,247 | 7/1896 | Hirsch . | |
| 1,157,568 | 10/1915 | Mills . | |
| 1,806,905 | 5/1931 | Kampfman . | |
| 1,886,115 | 11/1932 | Müller . | |
| 2,002,564 | 5/1935 | Bergman | 206/604 |
| 2,099,425 | 11/1937 | Goodman . | |
| 2,248,266 | 7/1941 | Abrams . | |
| 2,333,587 | 11/1943 | Salfisberg . | |
| 2,870,955 | 1/1959 | Brady et al. . | |
| 2,952,399 | 9/1960 | Searle . | |
| 3,054,441 | 9/1962 | Gex et al. | 156/515 |
| 3,061,169 | 10/1962 | Yermakoff et al. . | |
| 3,196,728 | 7/1965 | Snow | 83/618 |
| 3,208,192 | 9/1965 | Schaefer | 53/30 |
| 3,323,707 | 6/1967 | King . | |
| 3,343,664 | 9/1967 | Poitras . | |
| 3,370,782 | 2/1968 | Hickman . | |
| 3,390,507 | 7/1968 | Repko | 53/14 |
| 3,412,918 | 11/1968 | Sherman | 229/7 |
| 3,608,815 | 9/1971 | Bunch . | |
| 3,625,351 | 12/1971 | Eisenberg . | |
| 3,642,126 | 2/1972 | Kurtz et al. | 206/63.3 |
| 3,797,732 | 3/1974 | Melin et al. | 206/554 |
| 3,802,324 | 4/1974 | Izumi et al. . | |
| 3,809,220 | 5/1974 | Arcudi | 206/484 |

FOREIGN PATENT DOCUMENTS

| | | |
|---|---|---|
| 1394228 | 2/1965 | France . |
| 1399493 | 4/1965 | France . |

*Primary Examiner*—Stephen P. Garbe

*Attorney, Agent, or Firm*—E. Kelly Linman; John V. Gorman; Richard C. Witte

[57] ABSTRACT

An "easy open" feature for a sealed flexible pouch and method and apparatus for accurately positioning said feature in the sealed border region of said flexible pouch. The feature comprises a stress concentrating aperture exhibiting a strong tendency to initiate a directional tear while maintaining integrity of the sealed pouch until an opening force is applied. In a preferred embodiment the pouches are cut from a moving web by a rotary shear cutter while a web punching means operatively connected with each cutter blade is engaged in the moving web. Because the web undergoes no movement relative to the cutting means or the punching means until both operations have been completed, the aperture is precisely positioned with respect to the severed edge of the pouch. In a particularly preferred embodiment, the sealed edge of the pouch is subjected to a high level of tension and is unsupported in the area of contact with the punching means during the aperturing operation. This concentrates the stress applied by the punching means and helps to form an aperture in the seal, even where tough and/or stretchy pouch materials which are prone to stretch and deform rather than rupture are employed. While the precise shape of the aperture is not critical, it is preferably non-circular in order to provide at least one area of stress concentration within the aperture and thereby facilitate tearing at relatively low levels of applied stress.

7 Claims, 20 Drawing Figures

ACCURATELY PLACED STRESS CONCENTRATING APERTURE IN FLEXIBLE PACKAGES

TECHNICAL FIELD

The present invention relates to forming "easy open" features in the seams of flexible pouches, and particularly to forming irregularly shaped "easy open" features.

BACKGROUND ART

"Easy open" features have been provided in the sealed regions of formed, filled, and sealed pouches in the past to facilitate opening of the sealed pouches. French Pat. No. 1,394,228 issued to Mauvernay on Feb. 22, 1965 is representative of such prior art practice. A line of perforations or a slit is formed in a sealed lateral seam spaced slightly below a sealed top seam that intersects perpendicularly the seam with the perforations or slit in it. A tear is initiated to open the pouch by twisting the lateral seam either across the perforations or parallel along the slit. The applied stress is thereby concentrated on the weakest area of the lateral seam, causing a tear to propagate from the perforations or slit, across the lateral seam and into the pouch in a direction generally parallel to the top seam. No method or apparatus for providing the perforations or slit is disclosed.

These prior art "easy open" features have been formed before the pouch is separated from a continuous web of filled and sealed pouches, interconnected at their lateral edges. For example, U.S. Pat. No. Re. 27,913 issued to Hutcheson on Feb. 5, 1974 discloses a process for forming a circular hole in a pouch seam using an electric eye which, when it recognizes indicia printed on the pouch, operates a reciprocating hole punching means. However, the web undergoes movement relative to the hole punching means before the transverse cut is effected downstream of the hole punching means. Accordingly, the accuracy of hole placement relative to the severed edge of the pouch with such a device is entirely dependent upon the consistency of response time of both the electric eye and the web advancing means.

U.S. Pat. No. 3,196,728 issued to Snow on July 27, 1965 discloses a machine for simultaneously punching a package support hole and an adjacent slit in a plastic package to weaken the package and thereby permit easy removal of the package when it is supported on a hook. The device disclosed in Snow operates in a manner similar to a conventional office hole punch.

It is also known in the prior art to provide cutting means for transversely cutting pouches comprised of thermoplastic film from a continuous web of interconnected pouches. Said transverse cutting is performed by means of a rotating spider employing heated metallic wires at spaced locations about its periphery while said web is secured to the periphery of a cylindrical drum on which said pouches are filled and sealed. U.S. Pat. No. 3,054,441 issued to Gex et al. on Sept. 18, 1962 describes such mechanism in detail. It is also known in the prior art to equip the transverse pouch cutting spider generally shown in FIG. 1 of the Gex et al. patent with phonograph needles mounted on radially extending arms located intermediate the heated wire cutting elements. The phonograph needles serve to puncture the body portions of the uppermost layer of thermoplastic film to allow air trapped within the pouch during the forming operation to escape. Puncturing of the body portion of the pouch by the needle is completed after the leading edge of the pouch has been severed, but prior to severance of the trailing edge of the pouch from the web. Accordingly, the portion of the pouch being punctured is not in tension during the puncturing operation.

A film perforating means utilized in conjunction with the pouch forming and transverse cutting mechanism generally disclosed in the aforementioned patent to Gex et al. is also disclosed in U.S. Pat. No. 3,208,192 issued to Schaeffer on Sept. 28, 1965. In the Schaeffer apparatus, the perforations are provided by means of a rotating spider having pointed arms, said spider being located ahead of the transverse cutting means. The spider is driven in timed relation to the drum so as to perforate only the body portions of a first web used to form said pouches. The body perforations formed in the web which contacts the exposed periphery of the drum permit air to be evacuated from within the pouches after filling and sealing, but prior to transverse cutting.

The prior art fails, however, to disclose simple and reliable web cutting means having punching means operatively connected therewith for continuously forming precisely registered "easy open" apertures in the sealed region of a pouch while the pouch is being severed from a continuously moving web. Furthermore, the prior art fails to disclose such means wherein said web is held stationary relative to said transverse cutting and said aperture punching means until both operations have been completed.

As will be appreciated by those skilled in the art, it is highly desirable that the stress concentrating aperture be accurately positioned with respect to the edge of the pouch. If the aperture is positioned too close to the pouch edge, it will be too easy to open the pouch, thereby increasing the likelihood that the pouch will be accidentally opened when handled or in transit. On the other hand, if the aperture is positioned too far from the pouch edge it may be difficult for the user to initiate a tear to open the bag, or even worse, the product-containing portion of the pouch may be penetrated. This is particularly undesirable where the product contained within the pouch is subject to degradation upon exposure to the atmosphere.

It is also desirable that the aperture have at least one internal area of stress concentration to facilitate initiating a tear when relatively low stress levels are applied thereto.

Accordingly, it is an object of the present invention to provide a flexible pouch having a stress concentration aperture precisely located in one of its seal areas, said aperture exhibiting a strong tendency to initiate a tear in the direction of the severed edge of the pouch rather than toward the pouch body when relatively low stress levels are applied thereto. It is another object of the present invention to provide simple and reliable method and apparatus for continuously forming precisely located stress concentration apertures in the sealed areas of pouches as they are severed from a continuous web of interconnected pouches. It is also an object of the present invention to ensure that the aperture is precisely positioned with respect to the edge of each pouch in automatic fashion, regardless of variations in web speed. It is still another object to provide a continuous process for forming precisely located stress concentration apertures wherein the means for providing said apertures are operatively connected with the means employed to sever said pouches from said web, said web being held stationary relative to said cutting and said aperturing means until both operations have been completed. It is yet another object of the present invention to provide such method and apparatus which will function reliably, even where tough and/or stretchy pouch materials are employed.

DISCLOSURE OF INVENTION

Disclosed herein is a novel "easy open" stress concentrating feature comprising an irregularly-shaped aperture located in the seal area of a flexible pouch. Also disclosed herein are novel process and apparatus for forming a precisely registered, "easy open" stress concentrating aperture adjacent a lateral edge of each filled and sealed pouch severed from a continuous web of pouches interconnected to one another along their lateral edges. The process preferably includes the step of operating a pouch cutting means operatively connected to a punching means to punch an aperture in the sealed lateral edges of the filled and sealed pouches as the adjacent lateral edge of each of said pouches is cut from the continuous web, said web being held stationary relative to said cutting means and said punching means until both operations have been completed. The aperture formed in the pouch is precisely located with respect to the lateral edge formed by the pouch cutting means to facilitate consistent easy opening of the pouch. Furthermore, the aperture is preferably shaped to provide at least one internally-located area of stress concentration. Unlike the circular perforation taught by the prior art, the area of stress concentration provided within an aperture of the present invention tends to facilitate tearing the area between said aperture and the adjacent severed edge of the pouch at relatively low applied force levels. Once the edge of the pouch has been broken by the tear, the remainder of the pouch is easily opened by manually separating the pouch segments on opposite sides of the tear from one another.

Also disclosed is a preferred embodiment of a machine for forming pouches with such precisely registered "easy open" apertures from a continuous web of pouches interconnected to one another at their lateral edges. The machine includes a pouch cutter for making transverse cuts across the moving web to separate the pouches from the web. It further includes at least one cutting blade having an aperturing punch operatively connected to it. The punch is so spaced from the edge of the pouch cutting blade that it will form a stress concentrating aperture spaced the desired distance from the adjacent transverse cut. The unsupported web is contacted by the punch while in tension to ensure that the punch bursts through the web. In a particularly preferred embodiment, the punch forms an aperture having at least one internally located area of stress concentration.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE INVENTION

Figure 1:
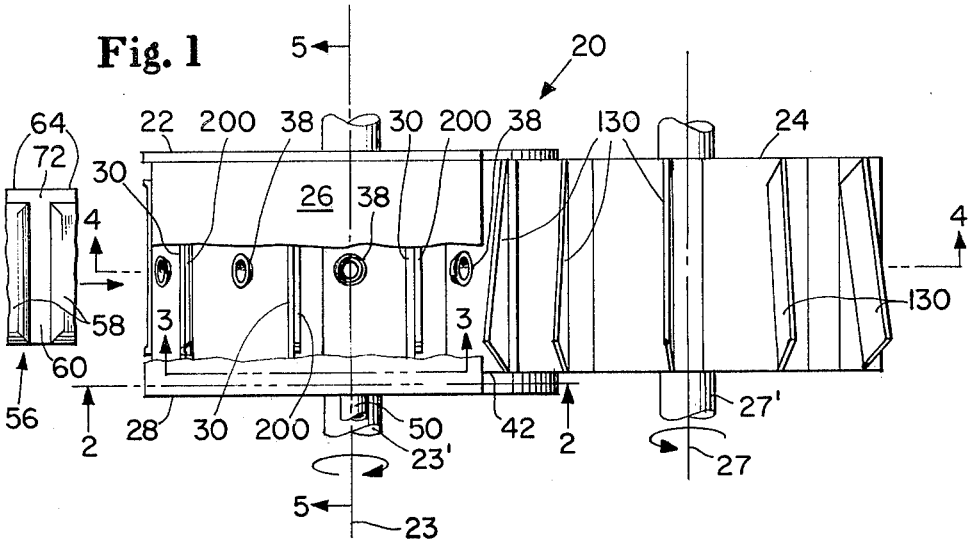
FIG. 1 is a simplified plan view of a preferred apparatus of the present invention with the web of interconnected pouches normally processed thereon partially broken away for clarity.

Referring to the drawings wherein like reference characters are utilized for like parts throughout the several views, there is shown in FIG. 1 a rotary shear cutter 20. The cutter 20 includes a driven forwarding roll 22 and a driven mating roll 24 which rotate about parallel axes 23, 27 on shafts 23', 27', respectively, in opposite directions with respect to one another. In the embodiment shown in FIGS. 1 and 4, forwarding roll 22 rotates in a clockwise direction, while mating roll 24 rotates in a counterclockwise direction. A saddle-shaped guide 26 straddles forwarding roll 22 and serves to position a web 56 of interconnected pouches 64 to be cut on forwarding roll 22. The web 56, which is fed onto forwarding roll 22 under tension, has, in FIG. 1, been partially broken away for clarity. The cutter 20 also includes a vacuum commutator 28 which abuts an end of forwarding roll 22.

Figure 4:
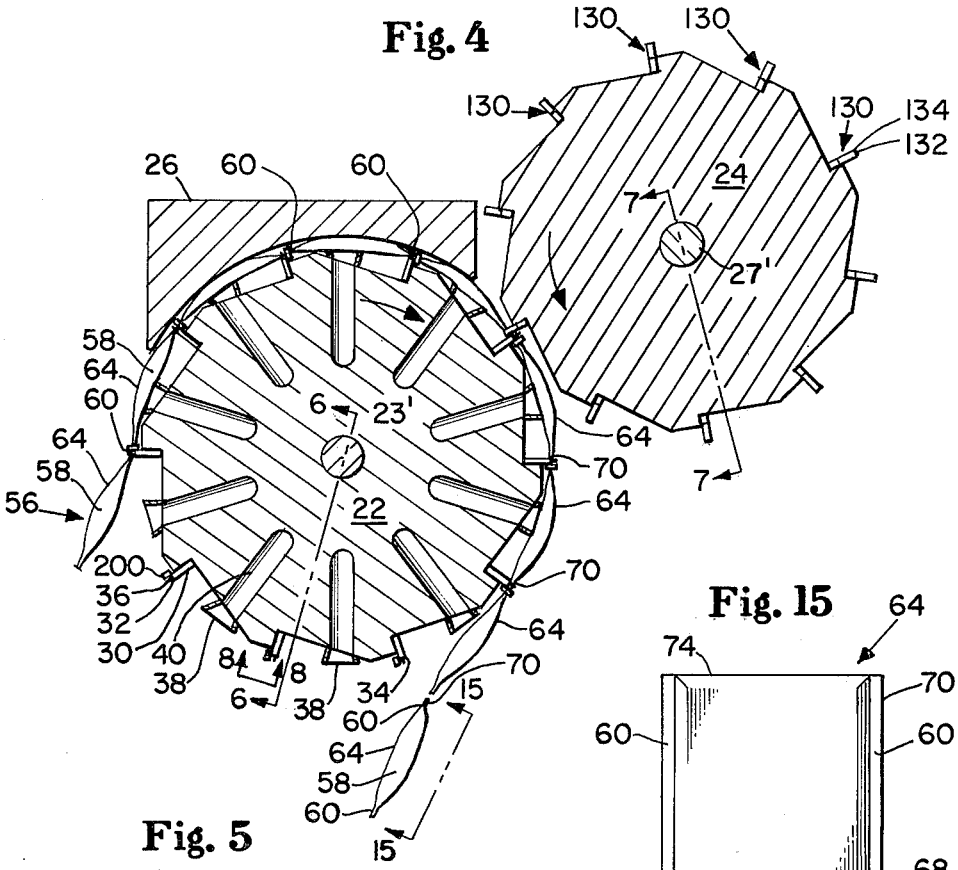
FIG. 4 is a cross-sectional view taken along section line 4—4 of FIG. 1, showing a web of interconnected pouches being processed in accordance with the present invention.

As is clearly shown in FIG. 4, each of the rolls 22, 24 has mounted about its periphery equally spaced, radially aligned cutting blades 30, 130, respectively. The blades 30, 130, which are preferably fabricated so as to be identical to one another, extend across the axial length of the rolls 22 and 24. As can be more clearly seen from FIGS. 6 and 7, cutting blades 30 are mounted on forwarding roll 22 with their cutting corners 34 in parallel alignment with the axis 23 of roll 22, while cutting corners 134 of cutting blades 130 are nonparallel to the axis 27 of mating roll 24. As shown in FIG. 7, the angular alignment of cutting blades 130 with respect to axis 27 of roll 24 produces a maximum effective radius $R_1$ at the uppermost end 144 of blade 130 and a minimum effective radius $R_2$ at the lowermost end 154 of blade 130. The angular alignment of cutting blades 130 has been exaggerated for clarity. Furthermore, it will be appreciated by those skilled in the art that shaft 27' on which mating roll 24 is mounted is resiliently supported to allow at least a degree of deflection to occur as said shearing operation takes place. This ensures point contact between cutting corners 34 and 134 without causing damage to blades 30 and 130.

As can be seen in FIG. 4, the angular spacing arrangement of blades 30 and 130 around the periphery of rolls 22 and 24 is identical. Accordingly, the two rolls are adjusted in their position with respect to one another so that when they counterrotate a cutting corner 34 of each blade 30 on roll 22 will come into shearing abutment with a corresponding cutting corner 134 of a mating blade 130 on roll 24. FIGS. 9–14, which disclose a complete cutting and punching cycle for one pouch, clearly disclose that the distance between the axes 23 and 27 of rolls 22 and 24 is such that the cutting blades 30 and 130 on the two rotating rolls intermesh sufficiently to produce a scissors-like cutting action completely across the web 56 of interconnected pouches 64.

Figure 6:
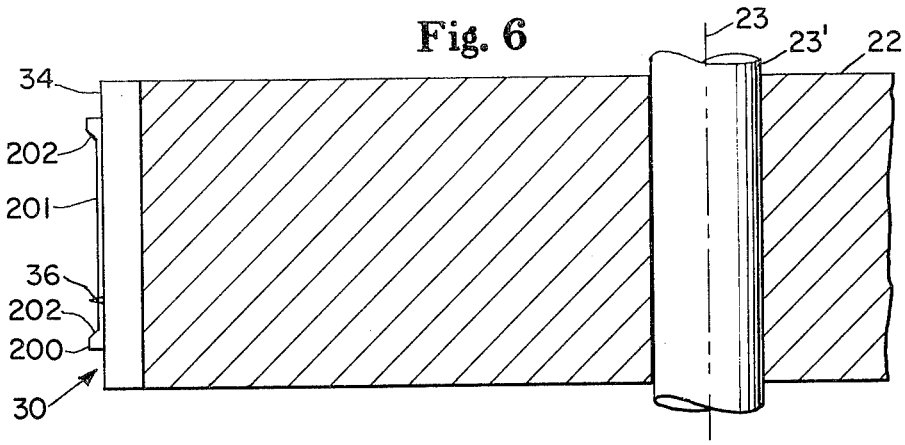
FIG. 6 is a simplified view taken along section line 6—6 of FIG. 4.
Figure 7:
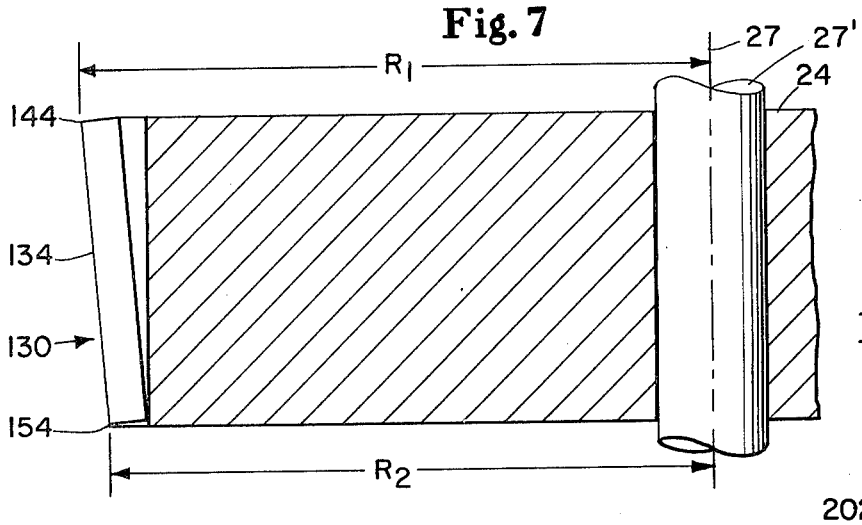
FIG. 7 is a simplified view taken along section line 7—7 of FIG. 4.
Figure 8:
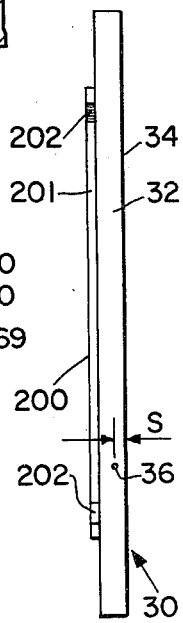
FIG. 8 is an enlarged view taken along view line 8—8 of FIG. 4.

As can be seen in FIGS. 6 and 8, each of the blades 30 on forwarding roll 22 has secured to its exposed peripheral surface 32 at least one pin 36 which extends radially outward beyond peripheral surface 32 of the blade. As can be seen from FIGS. 8 and 9, it is the pin's spacing "S" from cutting corner 34 of each blade 30 which controls the position of the stress concentrating aperture 68 in the finished pouch 64 relative to the severed edge 70 of the pouch. As is also apparent from FIGS. 6, 8 and 9–14, each blade 30 on forwarding roll 22 is provided with a web support member 200 which, in a preferred embodiment, is adjustably secured thereto by means well known in the art. Each web support member 200 is provided with a recessed land area 201 having an overall length substantially equal to the width of web 56. The tapered sections 202 of web support member 200 serve to align the web 56 with land areas 201, thereby ensuring that the stress concentration aperture 68 is spaced the desired distance from the top seal 72 of each pouch 64 cut from the web. As can be seen from FIGS. 9–14, the maximum height of pin 36 above the peripheral surface 32 of blade 30 must not be so great that any portion of mating blade 130 on mating roll 24 will interfere with the pin 36 as it rotates past. This is more clearly illustrated in FIG. 9, wherein the criticality of the angular mounting of blade 130 relative to axis 27 can be clearly discerned. The shear cutting action imposed on web 56 along transverse seal 60 is also due to the angular inclination of blades 130 to axis 27, since it is the result of cutting corner 134 of blade 130 riding across cutting corner 34 of blade 30, as generally shown in FIGS. 9–14.

When used on hand-sized film pouches, pin 36 may conveniently be a piece of music wire made of hardened spring steel, and having a diameter from about 0.15 millimeters to about 2 millimeters. The pin is preferably recessed into the blade 30 to a depth between about 0.5 to about 1.5 centimeters. It is preferably secured in blade 30 by means of a set screw (not shown) which threads into the blade transverse to the length of the pin and butts against the pin at an intermediate point along its length.

Since the properties of different types of film vary greatly, and since different films may be employed to provide the characteristics desired in the finished pouch, the pin size, sharpness and configuration are preferably optimized by preliminary testing on sample pouches to determine their resistance to puncture. Furthermore, since the spacing between the edge of the stress concentration aperture and the severed edge of the pouch can be precisely controlled in the practice of the present invention, the amount of force required to initiate pouch opening can be designed into the finished pouch by proper selection of aperture shape, size and position relative to the severed edge. The exposed pin tip may, for example, be relatively sharp and tapered. It may also be conical, beveled, or irregularly shaped to provide the desired aperture configuration in the web 56. If desired, the pin cross-section can also exhibit the preferred shape along its entire length to accommodate pin wear without appreciably changing the shape of the stress concentrating aperture 68 produced in the web. A non-round pin cross-section may also be used to consistently orient a non-cylindrical pin relative to blade 30.

As can be seen from FIGS. 9–14, a stress concentration aperture 68 in the web 56 and the adjacent transverse cut across the web are made essentially simultaneously, web 56 being held stationary relative to both the cutting means and the punching means until both operations have been completed. Thus, there is no loss of registration between the severed edge 70 of pouch 64 and the adjacent stress concentration aperture 68 where, as in the illustrated embodiment, the cutting and punching means are operatively connected with one another.

In the illustrated embodiment, the transverse cut is made while the implement used to form the adjacent stress concentration aperture is engaged in the web. As shown in FIGS. 9–14, pin 36 is caused to penetrate the web 56 as blades 30 and 130 perform the adjacent transverse cutting operation is shear-like fashion along corners 34 and 134. Web support members 200 serve to elevate the web 56 across the peripheral surface 32 of blade 30. The web support members 200, which contact web 56 along their land areas 201, are radially adjustable either inwardly or outwardly by means well known in the art to accommodate pouches of varying capacities and to vary the amount of tension applied to that portion of web 56 intermediate cutting corner 34 of blade 30 and the web support member.

The pouch 64 being severed from web 56 is secured to forwarding roll 22 by means of a suction gripper 38 during the aperturing operation. In addition the product within pocket 58 of the pouch being severed resists the pouch's being drawn across the leading edge of web guide 200 during the aperturing operation. Accordingly, the shearing action provided as blades 30 and 130 about one another along their cutting corners 34 and 134 causes that portion of web 56 intermediate support member 200 and cutting corner 34 to be drawn while in an unsupported condition into contact with the exposed tip of pin 36, thereby causing relatively high tension and extremely high stress concentration at the point of pin contact. This results in bursting of the seal area 60 of the web 56 by pin 36 and formation of a stress concentrating aperture 68 therein.

In many situations, the pouch is comprised of a relatively tough and/or stretchy material which is highly resistant to rupture. In addition, the bonded seal areas to be apertured are of double thickness. Thus it is the localized tension applied during transverse cutting by blades 30 and 130 and the resulting stress concentration at the tip of pin 36 which helps the pin burst the seal area to form aperture 68. It should be noted that where tough and/or stretchy pouch materials are employed, the distance over which the localized tension is applied, i.e., the distance as measured along web 56 between cutting corner 34 and web guide 200, is preferably minimized to avoid large scale web deformation by pin 36 without rupture thereof.

Figure 9:
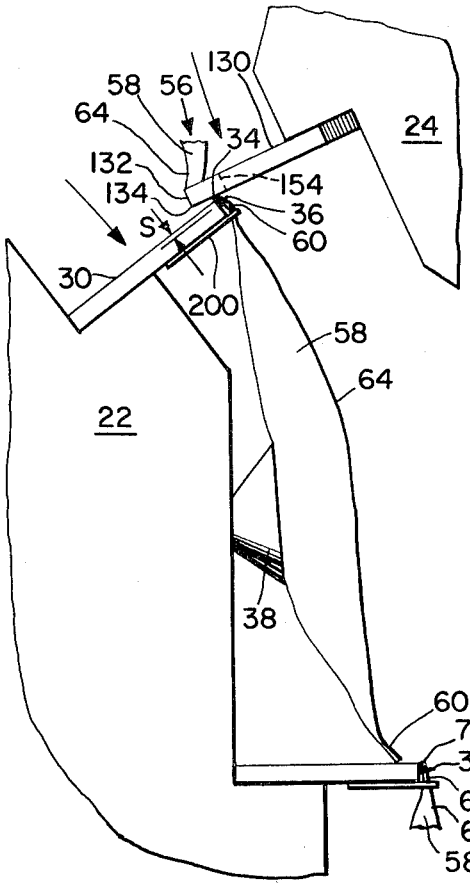
FIGS. 9–14 are enlarged fragmentary views of the cutting apparatus shown in FIG. 4, showing a complete pouch cutting and punching cycle.
Figure 10:
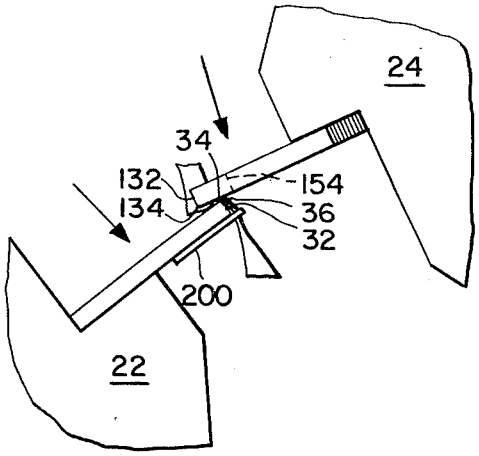

As will be appreciated from FIG. 9, that portion of web 56 containing stress concentration aperture 68 forms the hypotenuse of a triangle having a base comprising peripheral surface 32 of blade 30 and an altitude comprising that portion of web support member 200 between land area 201 and the peripheral surface 32 of blade 30. Because the stress concentration aperture 68 is formed while the web is at an angle to pin 36, the stress concentration aperture 68 will not, in most instances, be identical to the cross-section of the pin tip. If an aperture having a shape substantially the same as that of the cross-section of the pin tip is desired, the pin tip may be bent or mounted at an angle with respect to blades 30 so as to intersect web 56 essentially perpendicularly at the point of contact. Accordingly, the novel process and apparatus disclosed herein may be used with equal facility to form either novel stress concentrating apertures of the present invention or conventional prior art stress concentrating apertures such as circular performations or slits.

As will also be appreciated, the precise location of the aperture 68 relative to the cut edge 70 of pouch 64 corresponds to the distance between cutting corner 34 of blade 30 and the adjacent edge of pin 36, as measured along the hypotenuse of the triangle described earlier herein.

Figure 11:
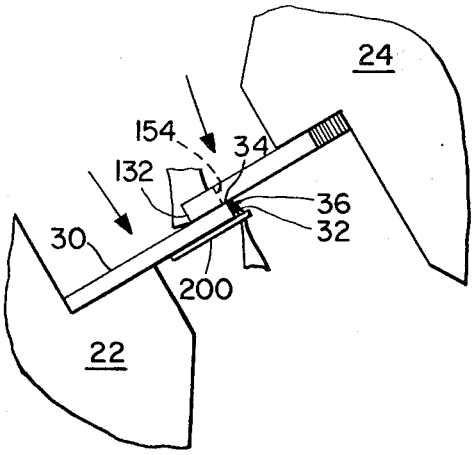
Figure 12:
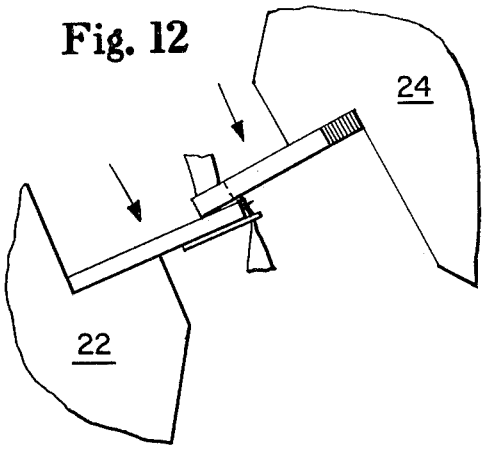
Figure 13:
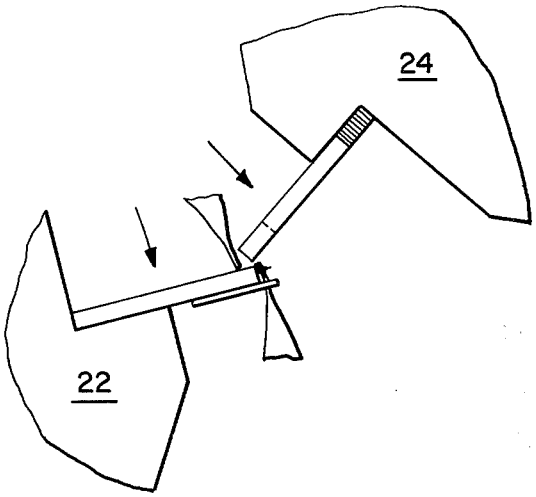
Figure 14:
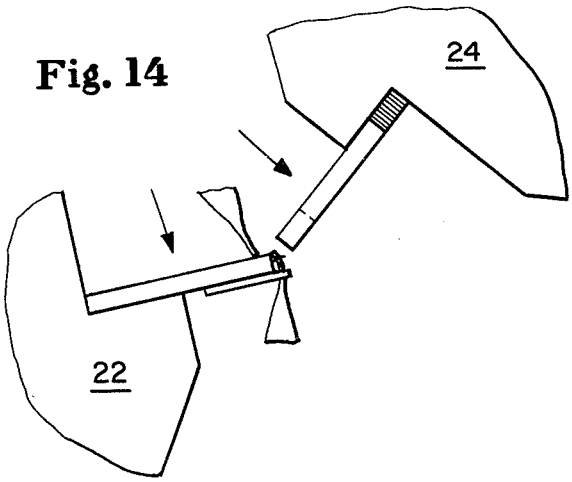

FIG. 11 represents the condition existing after the shear cut of web 56 has been completed and lowermost edge 154 of cutting blade 130 projects below cutting corner 34 of blade 30. FIGS. 12 and 13 represent the condition prevailing relative to a pair of mating blades 30 and 130 after the transverse cut of web 56 has been completed and the discrete pouch 64 proceeds forward secured to roll 22.

Figure 3:
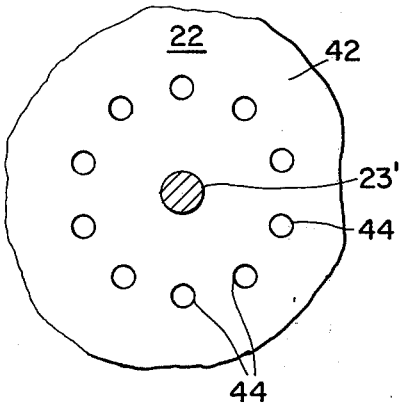
FIG. 3 is a fragmentary cross-sectional view taken along section line 3—3 of FIG. 1.
Figure 5:
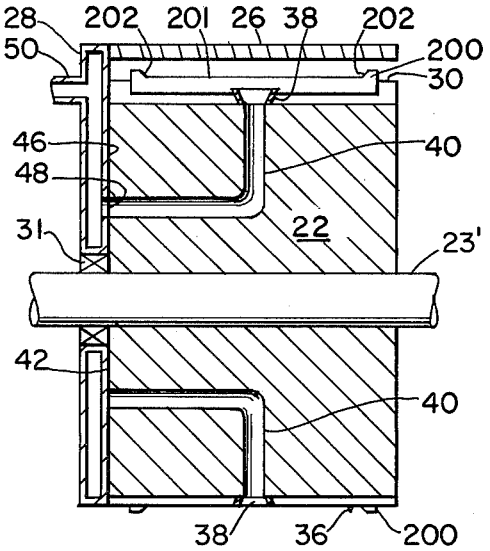
FIG. 5 is a cross-sectional view taken along section line 5—5 of FIG. 1.

Forwarding roll 22 preferably includes a series of frusto-conical vacuum grippers 38 situated mid-way between each pair of adjacent blades 30 on the periphery of roll 22. The functioning of grippers 38, shown in FIG. 4 in cross-section, is controlled by vacuum commutator 28. Each of the grippers 38 communicates with end wall 42 of roll 22 adjacent the vacuum commutator 28 by means of L-shaped ducts 40 which extend radially into the roll from the respective grippers 38 and axially along the roll to end wall 42 as shown in FIG. 5. Circular openings 44, shown in FIG. 3, created in end wall 42 by the emergence of L-shaped ducts 40 from roll 22 communicate with commutator 28.

Figure 2:
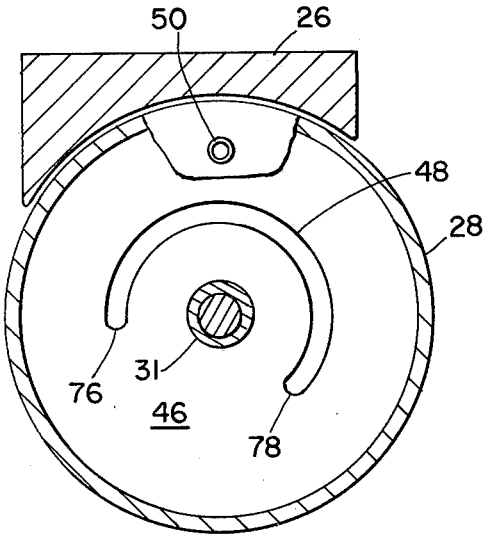
FIG. 2 is a cross-sectional view taken along section line 2—2 of FIG. 1, with the vacuum source connection to the commutator shown in fragmentary fashion for added clarity.

The commutator 28 is preferably a hollow cylindrically-shaped chamber whose axis is colinear with that of roll 22, but which is mechanically isolated, conveniently by means of bearing 31, from shaft 23' which passes through its center. Rotation of commutator 28 is prevented by attachment (not shown) to guide 26 which is fixed. An arcuate U-shaped slot 48, shown in FIG. 2, is cut in the commutator's forward face 46 which abuts end wall 42 of forwarding roll 22. The diameter of the arc defined by slot 48 is identical to the diameter of the arc containing openings 44. The U-shaped slot 48, whose width in the radial direction equals the diameter of the openings 44 in end wall 42, extends through an arc sufficient to achieve the desired cycle of vacuum application, as explained hereinafter. A vacuum line 50 which connects to a vacuum source (not shown) maintains a vacuum in the interior portions of the commutator 28. The commutator 28, which is stationary, fits snugly against the moving end wall 42 of the roll 22. In order to decrease the friction between end wall 42 of roll 22 and the exposed face 46 of commutator 28 either or both of their abutting surfaces may be made from a low friction material such as Teflon or the like.

When the openings 44 in end wall 42 initially come into communication with the U-shaped slot 48 shown in FIG. 2, suction is applied via L-shaped ducts 40 to the suction grippers 38 connected to said openings. Conversely, when openings 44 are occluded by the exposed face 46 of commutator 28 at the end of U-shaped slot 48 no vacuum is applied to grippers 38, and the previously established vacuum is quickly lost so that no suction is present at the affected grippers.

The saddle-shaped guide 26, which is mounted on a fixed support (not shown), serves to guide the tensioned incoming web to be cut over roll 22 and down into the nip between forwarding roll 22 and mating roll 24. The guide 26, in conjunction with web support members 200 secured to blades 30, adjusts the radial position of the web to be cut with respect to roll 22. The guide 26 is concave to conform to the shape of the roll 22, but is spaced sufficiently therefrom to just allow the web 56 to pass therebetween. The pressure applied by guide 26 against the web 56 causes the web to be pressed against the blades 30 and the vacuum grippers 38. In this way the web 56 is held tightly between adjacent blades 30, and jamming of the web in the nip between rolls 22 and 24 is prevented. Preferably, the pressure supplied by guide 26 and the tension present in web 56 is sufficient to initiate deformation, if not impaling, of the moving web 56 on pins 36. This further aids in maintaining the spacing between adjacent pouches 64.

In operation the web processing system of the present invention preferably works as follows. A planar sheet of web stock is folded upon itself, preferably about its centerline, and pockets 58 defined intermediate transverse seals 60 are continuously formed at spaced locations along its length. The moving web 56 is then filled, and a top seal 72 is applied continuously along the length of the web to provide sealed interconnected pouches 64. The completed web of interconnected pouches 64 is continuously forwarded into rotary shear cutter 20. The moving web 56 is passed while under tension between guide 26 and forwarding roll 22, which is indexed to position a pouch 64 over a vacuum gripper 38, while the sealed lateral portions 60 between each filled pouch 64 are centered over the cutting corner 34 of a blade 30, as shown in FIG. 4.

The web 56 is pressed by guide 26 against the rotating forwarding roll 22, preferably initiating deformation, if not impalement, of the sealed lateral portion 60 by the upstanding pin 36 in each blade 30. The tension present in web 56 and the direction provided by guide member 26 and web support members 200 secured to blades 30 interact with one another to center the web on land areas 201 of the support members. Suction is preferably applied to grippers 38 as soon as the web 56 comes in contact therewith, as generally shown in FIG. 4. This causes each pouch 64 in web 56 to be held precisely between two blades 30 as the pocket enters the region between guide 26 and roll 22.

Each pouch 64 in web 56 held by a vacuum gripper 38 is forwarded past guide 26 and into the nip between forwarding roll 22 and mating roll 24. As is shown in FIGS. 9–14, the moving web 56 is transversely cut as it passes through the nip at spaced locations along the web, each transverse cut being located at the approximate center of each transverse seal 60. This is accomplished by the shearing action of cutting corners 34 and 134 of mating blades 30 and 130 on each roll. More specifically, the forward cutting corner 134 of blade 130 slides across cutting corner 34 on blade 30, causing the sealed lateral portion 60 of the moving web 56 which is situated in between to be sheared. If the web 56 was not previously impaled by pin 36 between guide 26 and roll 22, or was incompletely impaled prior to entering the nip, the puncturing operation is completed in the nip as the localized web tension is increased by the vacuum gripper 38 in contact with the pouch being severed, the web support member 200 in contact with said pouch, and the shearing blades 30 and 130 effecting the transverse cut, as generally shown in FIGS. 9–14.

Whether the stress concentration aperture 68 is completed in the nip or between roll 22 and guide 26, the spatial relationship between the transverse cut and the stress concentration aperture 68 is fixed, since the transverse cut is made in the nip while the web is still engaged on pin 36. Similarly, if the stress concentration aperture 68 and the transverse cut are made essentially simultaneously in the nip, there is no movement of the web 56 relative to either the cutting or the punching means until both operations have been completed.

As the trailing sealed lateral portion 60 of each pocket 58 in web 56 passes into the nip it is cut by blades 30 and 130, as described earlier herein, thereby totally separating a finished discrete pouch 64 having a precisely located "easy open" stress concentration aperture 68 in its lateral seal area. Each discrete pouch 64 is secured by suction to forwarding roll 22 until it reaches a point generally underneath the roll where suction is discontinued, as described earlier herein, thereby allowing the pouch to fall into a hopper or continuous motion conveyor (not shown). Again, the length of pin 36 must not be so great as to cause the pouch to hang-up and thereby cause tearing of the lateral seam all the way to the severed edge 70 of the pouch.

The intermittent application of vacuum to the web and pouches described above is accomplished by means of a conventional vacuum commutator 28, as described earlier herein. Vacuum is applied to grippers 38 upon introduction of web 56 onto roll 22. Vacuum is maintained in grippers 38 as the gripper openings 44 follow the path of U-shaped slot 48 around to its trailing edge 78. As each opening 44 passes beyond the trailing edge 78 of the slot 48, the corresponding gripper 38 is isolated from the vacuum source connected to the commutator until the opening 44 again comes into communication with the leading edge 76 of the slot 48. Thus, after each opening 44 passes beyond trailing edge 78, vacuum is released and the finished pouches 64 are released.

If desired, a source of pressurized air can be connected to the commutator 28 downstream of the vacuum slot 48 to expel the finished pouches 64. In such a system, pressurized air is preferably supplied through a pipe (not shown) which extends through commutator 28 so that its open end exits out of forward face 46 and faces end wall 42 at a point just past trailing edge 78 of slot 48 so as to communicate with openings 44 as they rotate past the open end of the pipe. The pressurized air that exits out of the pipe passes through duct 40 and out the gripper 38 connected thereto, blowing off the finished pouches 64.

Figure 15:
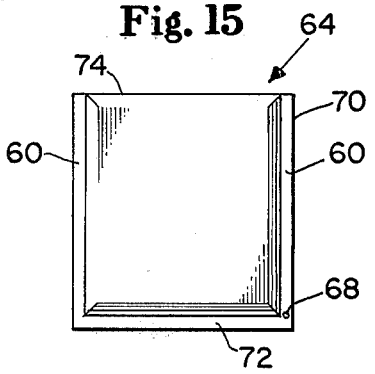
FIG. 15 is an enlarged view, taken along view line 15—15 of FIG. 4, of a discrete pouch processed in accordance with the present invention to provide an "easy open" aperture of the present invention in one of its lateral seals.

A completed pouch 64 of the present invention, shown in FIG. 15, contains a stress concentrating aperture 68 precisely spaced from the recently severed lateral edge 70 of the pouch. The aperture is preferably located just below the upper sealed region 72 of the pouch.

Figure 16:
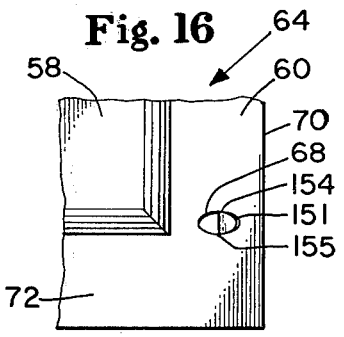
FIG. 16 is an enlarged view of the stress concentrating aperture portion of the pouch shown in FIG. 15.

The distance between aperture 68 and the adjacent edge 70 is controlled by the size and configuration of pin 36, the distance "S" between pin 36 and the adjacent cutting corner 34 of blade 30 and the distance between land area 201 of web guide 200 and peripheral surface 32 of blade 30. The preferred distance between the severed edge of the pouch and the nearest edge of the aperture will, of course, depend on the pouch materials used, the total width of the lateral seals and the size and configuration of the aperture. A distance of about 0.6 mm. has provided reliable manual opening when used with a cylindrical 1.6 mm. diameter, conical tipped pin on laminated plastic pouches having a 6 mm. lateral seam width after cutting, said pouches being made of oriented polypropylene laminated to a saran coated polyethylene and ethylene vinyl acetate copolymer, said laminate structure having an individual wall thickness of about 3.5 mils. The aperture 68 typically created by a conical tipped pin mounted as illustrated herein is irregularly shaped, as generally shown in FIG. 16. Since no web material is physically removed by pin 36, a flap 151 of web material is formed, usually at the trailing edge of aperture 68. For small size apertures, the displaced flap may be of benefit in directing attention to the "easy open" feature by conveying a visual and/or tactile impression to the person seeking to open the pouch. The areas of stress concentration are at corners 154 and 155. Stress concentrations 154 and 155 reduce the level of applied force required to initiate a tear from aperture 68 to adjacent severed edge 70. Once a tear is initiated between one of the stress concentrations in aperture 68 and the adjacent pouch edge 70, it is relatively easy to open the pouch in a direction generally parallel to top seal 72 by separating the pouch segments on opposite sides of the tear from one another. This is believed due to the relatively high shear forces which can easily be exerted as the length of the torn segments increases, since the angle between the segments can more readily be increased to essentially 180°.

If desired, a second "easy open" stress concentration aperture 68 can be provided along severed edge 70 of pouch 64 adjacent pouch edge 74 so that the pouch can be opened from either of two ends. As will be appreciated by those skilled in the art, edge 74 may be a fold in the web material comprising pouch 64, or a seal area where the pouches are formed by bonding two discrete webs together. Furthermore, two or more pins 36 may be positioned side-by-side across the peripheral surface 32 of each blade 30 on the cutter 20 shown in FIGS. 1 and 4 to produce a line of stress concentration apertures across the width of the sealed lateral portion 60 of pouch 64. In such circumstance, the height of each succeeding pin may need to be increased as the distance thereof from cutting corner 34 increases. This will ensure web impalement despite the web's increased distance from peripheral surface 32 of blade 30.

Figure 17:
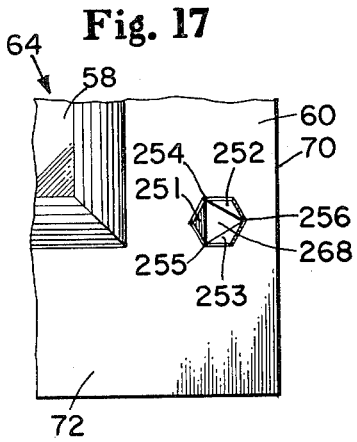
FIG. 17 is a view generally similar to FIG. 16, but showing an alternatively shaped stress concentrating aperture of the present invention.

FIG. 17 discloses an alternative stress concentrating aperture 268. Aperture 268 is preferably formed utilizing a sharpened pin having a triangular shape. The triangular-shaped pin is preferably oriented so that one of its bases forms the leading edge, i.e., the edge closest pocket 58, of aperture 268. Three triangular-shaped flaps 251, 252 and 253 of web material are typically formed about the periphery of the aperture 268. Areas of stress concentration in aperture 268 are at 254, 255 and 256. As with stress concentrations 154 and 155, stress concentrations 254, 255 and particularly stress concentration 256 reduce the level of applied force required to initiate a tear from aperture 268 to adjacent severed edge 70.

Figure 18:
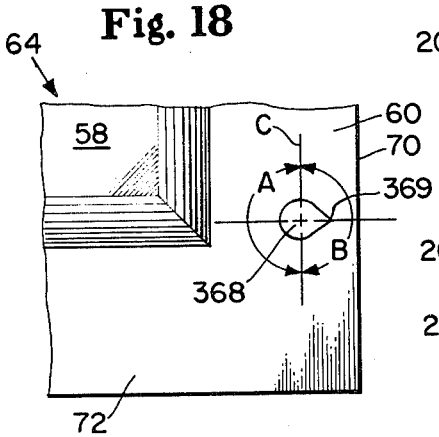
FIG. 18 is a view generally similar to FIG. 16, but showing a schematic representation of a stress concentrating aperture of the present invention.
Figure 19:
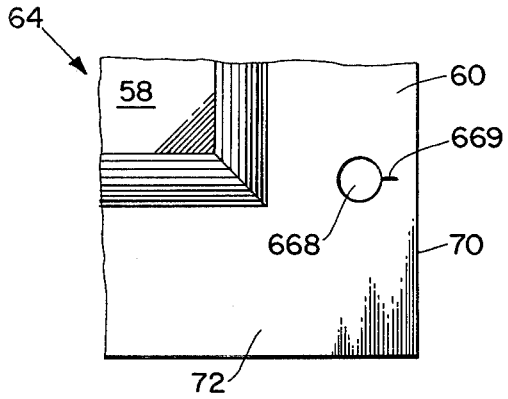
FIG. 19 is a view generally similar to FIG. 16, but showing an alternative embodiment of the present invention.
Figure 20:
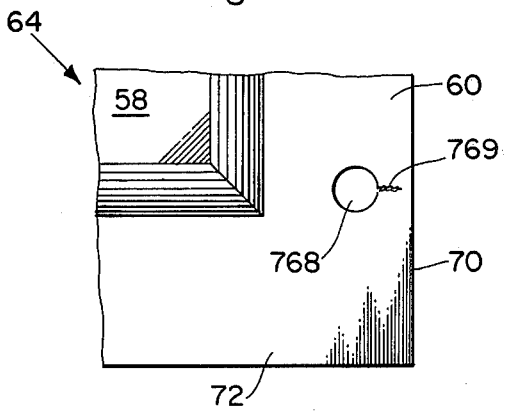
FIG. 20 is a view generally similar to FIG. 16, but showing still another embodiment of the present invention.

FIG. 18 is a schematic representation of a stress concentrating aperture 368 of the present invention. Dividing line "C" in FIG. 18 represents the point of maximum aperture width, as measured in a direction parallel to severed edge 70. In the event there is more than one point of maximum width within an aperture of the present invention, i.e., a square, dividing line "C" is located as close as possible to pocket 58 of pouch 64. Although the particular shape of aperture 368 is not critical, it is desirable to avoid inadvertant propagation of a tear into the pocket 58 of pouch 64 during handling. Accordingly, it is generally preferred in the practice of the present invention that those portions of aperture 368 to the left of dividing line "C", i.e., those portions of the aperture, if any, extending into area "A", as shown in FIG. 18, avoid the inclusion of sharp notches or other localized stress concentrating features. This minimizes the chance of inadvertant tear propagation into pocket 58 prior to manual opening of pouch 64. Conversely, those portions of aperture 368 on dividing line "C" or within Area "B", as shown in FIG. 18, preferably include one or more localized stress concentrating features such as sharp corners, notches, slits (e.g., slit 669 in aperture 668, as generally shown in FIG. 19), small tears (e.g., tear 769 in aperture 768, as generally shown in FIG. 20) and the like. In the embodiment schematically shown in FIG. 18, point 369 represents such a stress concentrating feature. By so confining the localized stress concentrating feature or features, the applied stress level required to initiate a tear from aperture 368 to severed edge 70 is greatly reduced. Once the tear from the localized stress concentrating feature in aperture 368 reaches severed edge 70, the pouch segments on opposite sides thereof can be readily separated from one another, since relatively high shear forces can more readily be applied as the length of the torn segments increases.

Although illustrated as a rotary shear cutter, the present invention can also be practiced with a rotary crush cutter, a reciprocating cutter, or other cutting apparatus well known in the art. A rotary crush cutter differs from the embodiment described herein in that the blades on the forwarding roll have sharp edges and mate with an appropriate anvil, which may be a rotating roll or a linearly moving belt. The anvil can have a rigid surface with indentations which conform to the sharp edged blades or it can have a deformable surface. An aperture punching pin can be mounted adjacent each sharp blade, and is preferably radially aligned with and spaced from the blade's sharp cutting edge. If desired, the pin may be cam-actuated to extend just prior to the instant of transverse cutting and punch an aperture in the web as the unsupported sealed portion thereof is being subjected to tension, said pin engaging said web until said transverse cut has been completed. The web 56 may thus be fed continuously between the rotary crush cutter and the anvil without the web undergoing movement relative to either the cutting or the punching means until the cutting and adjacent punching operations have been completed.

Similarly, a reciprocating cutter may be utilized instead of the rotary shear cutter described herein by substituting a rapidly reciprocating blade and an appropriate anvil. The pin which conveniently extends parallel to the blade to the height of the cutting edge of the blade, is mounted adjacent the sharp blade, with its cutting edge spaced from the cutting edge of the blade the distance which it is desired to separate the stress concentrating aperture from the lateral edge of the pouch. The cutter may be cam driven so as to sequentially reciprocate when a predetermined amount of web material has passed by or it may reciprocate in response to sensed information, such as electric eye sensed markings on the pouch. Preferably the web is forwarded intermittently to allow time for the cutter to operate. Alternatively, the entire cutter and punching assembly may be cam driven to follow the web during the pouch cutting and aperture punching operation. In either event, means well known in the art are provided for applying localized tension to the sealed portion of the web during the aperturing operation.

While the precise nature of the cutting or aperturing means is not critical, it is critical to the practice of the present invention that the web undergo no movement relative to the cutting or the punching means until both operations have been completed.

While particular embodiments of the invention have been illustrated and described, it will be obvious to those skilled in the art that various changes and modifications can be made without departing from the spirit and scope of the present invention, and it is intended to cover, in the appended claims, all such changes and modifications.

What is claimed is:

1. In a filled and sealed flexible pouch having a body portion and at least one stress concentrating aperture in a seal area thereof, said aperture being located adjacent an edge of said pouch to provide easy opening of said pouch by manual tearing, the improvement wherein said aperture includes at least one localized stress concentrating feature to preferentially initiate a tear generally in the direction of said adjacent edge of said pouch when stress is applied to the seal area containing said aperture, said localized stress concentrating feature in said aperture being located within that portion of said seal area which extends from the point of coincidence with the maximum dimension of said aperture, as measured in a direction substantially parallel to said adjacent edge of said pouch, to said adjacent edge of said pouch.

2. The improvement of claim 1, wherein said localized stress concentrating feature in said aperture comprises a notch.

3. The improvement of claim 1, wherein said localized stress concentrating feature in said aperture comprises a slit.

4. The improvement of claim 1, wherein said localized stress concentrating feature in said aperture comprises a tear.

5. The improvement of claim 1, wherein that portion of said aperture located intermediate that portion of said seal area which extends from the point of coincidence with the maximum dimension of said aperture, as measured in a direction substantially parallel to said adjacent edge of said pouch, to said body portion of said pouch is shaped to distribute stress applied to the seal area containing said aperture substantially uniformly along said portion of said aperture.

6. The improvement of claim 5, wherein that portion of said aperture located intermediate that portion of said seal area which extends from the point of coincidence with the maximum dimension of said aperture, as measured in a direction substantially parallel to said adjacent edge of said pouch, to said body portion of said pouch has a rounded shape.

7. The improvement of claim 6, wherein that portion of said aperture located intermediate that portion of said seal area which extends from the point of coincidence with the maximum dimension of said aperture, as measured in a direction substantially parallel to said adjacent edge of said pouch, to said body portion of said pouch is semi-circular.

* * * * *

UNITED STATES PATENT AND TRADEMARK OFFICE

CERTIFICATE OF CORRECTION

PATENT NO. : 4,332,327

DATED : June 1, 1982

INVENTOR(S) : ARTHUR E. FROHWERK and DAVID E. ENTING

It is certified that error appears in the above-identified patent and that said Letters Patent are hereby corrected as shown below:

Column 5, line 67, "to" should read -- and --.

Column 6, line 60, "about" should read -- abut --.

Signed and Sealed this

*Seventh* Day of *September 1982*

[SEAL]

*Attest:*

GERALD J. MOSSINGHOFF

*Attesting Officer*

*Commissioner of Patents and Trademarks*